US008544953B2

(12) United States Patent
Samain et al.

(10) Patent No.: US 8,544,953 B2
(45) **Date of Patent: *Oct. 1, 2013**

(54) LUMBAR SUPPORT ASSEMBLY AND CORRESPONDING SEAT STRUCTURE

(75) Inventors: Maxime Samain, Emelgem (BE); Bertrand Faulconnier, Sankt Augustin (DE)

(73) Assignee: L&P Swiss Holding AG, Wittenbach (CH)

( * ) Notice: Subject to any disclaimer, the term of this patent is extended or adjusted under 35 U.S.C. 154(b) by 0 days.

This patent is subject to a terminal disclaimer.

(21) Appl. No.: 12/950,360

(22) Filed: Nov. 19, 2010

(65) Prior Publication Data

US 2012/0126600 A1 May 24, 2012

Related U.S. Application Data

(63) Continuation of application No. 11/813,608, filed as application No. PCT/EP2005/010380 on Sep. 26, 2005, now Pat. No. 7,841,661.

(30) Foreign Application Priority Data

Jan. 12, 2005 (EP) ..... 05000499

(51) Int. Cl.
*A47C 3/00* (2006.01)

(52) U.S. Cl.
USPC ..... 297/284.4; 297/284.1

(58) Field of Classification Search
USPC ..... 297/284.4, 284.1
See application file for complete search history.

(56) References Cited

U.S. PATENT DOCUMENTS

| | | | |
|---|---|---|---|
| 1,182,854 | A | 5/1916 | Poler |
| 2,756,809 | A | 7/1956 | Endresen |
| 2,843,195 | A | 7/1958 | Barvaeus |

(Continued)

FOREIGN PATENT DOCUMENTS

| | | |
|---|---|---|
| AT | 401497 | 9/1996 |
| DE | 1276470 | 8/1968 |

(Continued)

OTHER PUBLICATIONS

European Search Report, European Patent Application No. 05 00 0499, dated Jul. 22, 2005.

(Continued)

*Primary Examiner* — David Dunn
*Assistant Examiner* — Erika Garrett
(74) *Attorney, Agent, or Firm* — Michael Best & Friedrich LLP

(57) ABSTRACT

A lumbar support assembly (2) comprises a support arrangement (3) which may have the form of a wire framework with two side wires (4) and a plurality of transverse wires (6). A Bowden cable arrangement (10) with a single Bowden cable is attached by two plate clips (15, 17) to the two side wires (4). A first end portion (13) of the wire (12) of the Bowden cable arrangement (10) is anchored to a front edge of a seat frame (1), while a second end portion (14) of the wire (12) is coupled to an actuator (20) for adjusting the tension of the Bowden cable. The lumbar support assembly (2) thus requires only one single Bowden cable to arch the lumbar support assembly at least in a lumbar region and to adjust the degree of lumbar support accordingly.

21 Claims, 6 Drawing Sheets

(56) References Cited

U.S. PATENT DOCUMENTS

Figure 1:
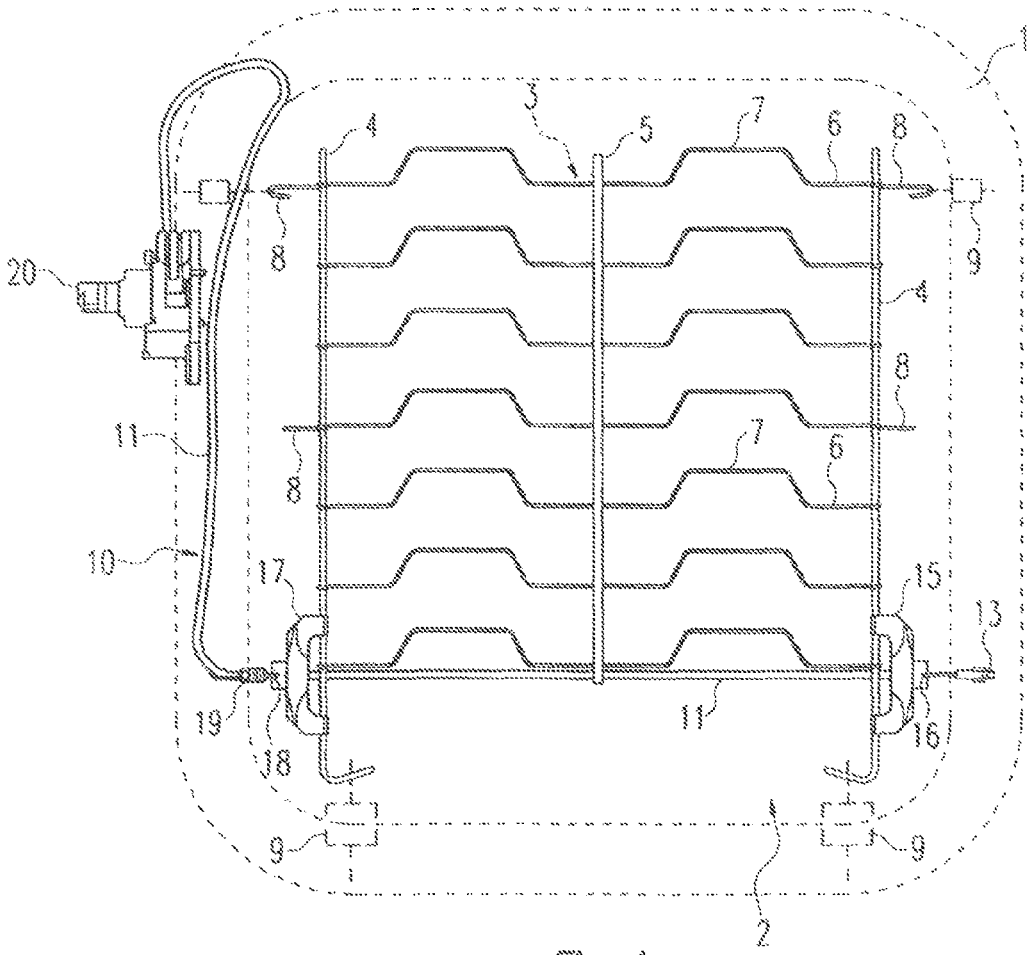

| | | | | |
|---|---|---|---|---|
| 2,922,416 | A | 1/1960 | Fader | |
| 2,942,651 | A | 6/1960 | Binding | |
| 3,378,299 | A | 4/1968 | Sandor | |
| 3,490,084 | A | 1/1970 | Schuster | |
| 3,492,768 | A | 2/1970 | Schuster | |
| 3,724,144 | A | 4/1973 | Schuster | |
| 3,762,769 | A | 10/1973 | Poschl | |
| 3,880,463 | A | 4/1975 | Shephard et al. | |
| 4,014,422 | A | 3/1977 | Morishita | |
| 4,136,577 | A | 1/1979 | Borgersen | |
| 4,153,293 | A | 5/1979 | Sheldon | |
| 4,156,544 | A | 5/1979 | Swenson et al. | |
| 4,182,533 | A | 1/1980 | Arndt et al. | |
| 4,295,681 | A | 10/1981 | Gregory | |
| 4,313,637 | A | 2/1982 | Barley | |
| 4,316,631 | A | 2/1982 | Lenz et al. | |
| 4,354,709 | A | 10/1982 | Schuster | |
| 4,390,210 | A | 6/1983 | Wisniewski et al. | |
| 4,449,751 | A | 5/1984 | Murphy et al. | |
| 4,452,485 | A | 6/1984 | Schuster | |
| 4,465,317 | A | 8/1984 | Schwarz | |
| 4,494,709 | A | 1/1985 | Takada | |
| 4,541,670 | A | 9/1985 | Morgenstern et al. | |
| 4,555,140 | A | 11/1985 | Nemoto | |
| 4,556,251 | A | 12/1985 | Takagi | |
| 4,561,606 | A | 12/1985 | Sakakibara et al. | |
| 4,564,235 | A | 1/1986 | Hatsutta et al. | |
| 4,565,406 | A | 1/1986 | Suzuki | |
| 4,576,410 | A | 3/1986 | Hattori | |
| 4,601,514 | A | 7/1986 | Meiller | |
| 4,602,819 | A | 7/1986 | Morel | |
| 4,627,661 | A | 12/1986 | Ronnhult et al. | |
| 4,630,865 | A | 12/1986 | Ahs | |
| 4,632,454 | A | 12/1986 | Naert | |
| 4,676,550 | A | 6/1987 | Neve De Mevergnies | |
| 4,679,848 | A | 7/1987 | Spierings | |
| 4,730,871 | A | 3/1988 | Sheldon | |
| 4,880,271 | A | 11/1989 | Graves | |
| 4,909,568 | A | 3/1990 | Dal Monte | |
| 4,915,448 | A | 4/1990 | Morgenstern | |
| 4,950,032 | A | 8/1990 | Nagasaka | |
| 4,957,102 | A | 9/1990 | Tan et al. | |
| 4,968,093 | A | 11/1990 | Dal Monte | |
| 5,005,904 | A | 4/1991 | Clemens et al. | |
| 5,022,709 | A | 6/1991 | Marchino | |
| 5,026,116 | A | 6/1991 | Dal Monte | |
| 5,050,930 | A | 9/1991 | Schuster et al. | |
| 5,076,643 | A | 12/1991 | Colasanti et al. | |
| 5,088,790 | A | 2/1992 | Wainwright et al. | |
| 5,112,106 | A | 5/1992 | Asbjornsen et al. | |
| 5,137,329 | A | 8/1992 | Neale | |
| 5,174,526 | A | 12/1992 | Kanigowski | |
| 5,186,412 | A | 2/1993 | Park | |
| 5,197,780 | A | 3/1993 | Coughlin | |
| 5,215,350 | A | 6/1993 | Kato | |
| 5,217,278 | A | 6/1993 | Harrison et al. | |
| 5,286,087 | A | 2/1994 | Elton | |
| 5,299,851 | A | 4/1994 | Lin | |
| 5,335,965 | A | 8/1994 | Sessini | |
| 5,385,531 | A | 1/1995 | Jover | |
| 5,397,164 | A | 3/1995 | Schuster | |
| 5,423,593 | A | 6/1995 | Nagashima | |
| 5,449,219 | A | 9/1995 | Hay et al. | |
| 5,452,868 | A | 9/1995 | Kanigowski | |
| 5,474,358 | A | 12/1995 | Maeyaert | |
| 5,498,063 | A | 3/1996 | Schuster et al. | |
| 5,505,520 | A | 4/1996 | Frusti et al. | |
| 5,518,294 | A | 5/1996 | Ligon, Sr. et al. | |
| 5,553,917 | A | 9/1996 | Adat et al. | |
| 5,562,324 | A | 10/1996 | Massara et al. | |
| 5,567,010 | A | 10/1996 | Sparks | |
| 5,567,011 | A | 10/1996 | Sessini | |
| 5,588,703 | A | 12/1996 | Itou | |
| 5,609,394 | A * | 3/1997 | Ligon et al. | 297/284.4 |
| 5,626,390 | A | 5/1997 | Schuster et al. | |
| 5,638,722 | A | 6/1997 | Klinger | |
| 5,651,583 | A | 7/1997 | Klingler et al. | |
| 5,651,584 | A | 7/1997 | Chenot et al. | |
| 5,704,687 | A | 1/1998 | Klingler | |
| 5,716,098 | A | 2/1998 | Lance | |
| 5,718,476 | A | 2/1998 | De Pascal et al. | |
| 5,758,925 | A | 6/1998 | Schrewe et al. | |
| 5,762,397 | A | 6/1998 | Venuto et al. | |
| 5,769,491 | A | 6/1998 | Schwarzbich | |
| 5,772,281 | A | 6/1998 | Massara | |
| 5,775,773 | A | 7/1998 | Schuster et al. | |
| 5,791,733 | A | 8/1998 | Van Hekken et al. | |
| 5,816,653 | A | 10/1998 | Benson | |
| 5,823,620 | A | 10/1998 | Le Caz | |
| 5,857,743 | A | 1/1999 | Ligon, Sr. et al. | |
| 5,868,466 | A | 2/1999 | Massara et al. | |
| 5,884,968 | A | 3/1999 | Massara | |
| 5,897,168 | A | 4/1999 | Bartelt et al. | |
| 5,911,477 | A | 6/1999 | Mundell et al. | |
| 5,913,569 | A | 6/1999 | Klingler | |
| 5,934,752 | A | 8/1999 | Klingler | |
| 5,954,399 | A | 9/1999 | Hong | |
| 5,975,632 | A | 11/1999 | Ginat | |
| 5,984,407 | A | 11/1999 | Ligon, Sr. et al. | |
| 5,988,745 | A | 11/1999 | Deceuninck | |
| 6,003,941 | A | 12/1999 | Schuster, Sr. et al. | |
| 6,007,151 | A | 12/1999 | Benson | |
| 6,030,041 | A | 2/2000 | Hsiao | |
| 6,036,265 | A | 3/2000 | Cosentino | |
| 6,045,185 | A | 4/2000 | Ligon, Sr. et al. | |
| 6,050,641 | A | 4/2000 | Benson | |
| 6,079,783 | A | 6/2000 | Schuster, Sr. et al. | |
| 6,089,664 | A | 7/2000 | Yoshida | |
| 6,092,871 | A | 7/2000 | Beaulieu | |
| 6,129,419 | A | 10/2000 | Neale | |
| 6,139,102 | A | 10/2000 | Von Moller | |
| 6,152,531 | A * | 11/2000 | Deceuninck | 297/284.4 |
| 6,152,532 | A | 11/2000 | Cosentino | |
| 6,158,300 | A | 12/2000 | Klingler | |
| 6,227,617 | B1 | 5/2001 | von Moller | |
| 6,227,618 | B1 | 5/2001 | Ligon, Sr. et al. | |
| 6,254,186 | B1 | 7/2001 | Falzon | |
| 6,254,187 | B1 | 7/2001 | Schuster, Sr. et al. | |
| 6,270,158 | B1 | 8/2001 | Hong | |
| 6,296,308 | B1 | 10/2001 | Cosentino et al. | |
| 6,334,651 | B1 | 1/2002 | Duan et al. | |
| 6,338,530 | B1 * | 1/2002 | Gowing | 297/284.4 |
| 6,357,826 | B1 * | 3/2002 | Gabas et al. | 297/284.4 |
| 6,364,414 | B1 | 4/2002 | Specht | |
| 6,430,801 | B1 | 8/2002 | Cosentino | |
| 6,520,580 | B1 | 2/2003 | Hong | |
| 6,536,840 | B1 | 3/2003 | Schuster, Sr. et al. | |
| 6,616,227 | B2 | 9/2003 | Blendea et al. | |
| 6,644,740 | B2 | 11/2003 | Holst et al. | |
| 6,652,029 | B2 | 11/2003 | McMillen | |
| 6,666,511 | B2 * | 12/2003 | Schuster et al. | 297/284.1 |
| 6,676,214 | B2 * | 1/2004 | McMillen et al. | 297/284.1 |
| 6,682,144 | B2 * | 1/2004 | Klingler | 297/284.4 |
| 6,746,081 | B1 | 6/2004 | Klingler | |
| 6,994,399 | B2 * | 2/2006 | Van-Thournout et al. | 297/284.4 |
| 7,311,358 | B2 | 12/2007 | White et al. | |
| 2002/0149245 | A1 | 10/2002 | Mundell | |
| 2003/0071501 | A1 | 4/2003 | Cruz Fernandes de Pinho et al. | |
| 2003/0085600 | A1 | 5/2003 | Mori | |
| 2003/0111885 | A1 | 6/2003 | McMillen | |
| 2006/0131937 | A1 * | 6/2006 | Vanthournout et al. | 297/284.1 |

FOREIGN PATENT DOCUMENTS

| | | |
|---|---|---|
| DE | 2040794 | 7/1971 |
| DE | 2064419 | 7/1972 |
| DE | 2947472 | 8/1980 |
| DE | 3341389 | 5/1985 |
| DE | 3616155 | 11/1987 |
| DE | 3624396 | 1/1988 |
| DE | 4220995 | 1/1994 |
| DE | 19750116 | 5/1999 |
| DE | 10005215 | 9/2001 |
| DE | 20107424 | 11/2001 |
| EP | 0006840 | 2/1982 |

| | | |
|---|---|---|
| EP | 0169293 | 10/1988 |
| EP | 0296938 | 12/1988 |
| EP | 0322535 | 7/1989 |
| EP | 0563709 | 10/1993 |
| EP | 0485483 | 1/1994 |
| EP | 0434660 | 5/1995 |
| EP | 0540481 | 12/1995 |
| EP | 0662795 | 12/1996 |
| EP | 0702522 | 3/1997 |
| EP | 0696251 | 7/1997 |
| EP | 0746219 | 11/1998 |
| EP | 0797399 | 11/1998 |
| EP | 0698360 | 3/2000 |
| EP | 1046539 | 10/2000 |
| FR | 2596334 | 10/1987 |
| GB | 849798 | 9/1960 |
| GB | 1423617 | 2/1976 |
| GB | 2013487 | 8/1979 |
| GB | 2059497 | 4/1981 |
| SU | 587924 | 2/1978 |
| WO | 98/09835 | 3/1998 |
| WO | 00/00064 | 1/2000 |
| WO | 02/24033 | 3/2002 |
| WO | 03/022626 | 3/2003 |
| WO | 03/103454 | 12/2003 |
| WO | 2004/043207 | 5/2004 |
| WO | 2004/043730 | 5/2004 |

OTHER PUBLICATIONS

International Search Report, International Patent Application No. PCT/EP2005/010380, mailed Feb. 10, 2006.

Written Opinion of the International Searching Authority, International Patent Application No. PCT/EP2005/010380, mailed Feb. 10, 2006.

* cited by examiner

LUMBAR SUPPORT ASSEMBLY AND CORRESPONDING SEAT STRUCTURE

This application is a continuation of U.S. patent application Ser. No. 11/813,608 filed Jun. 6, 2008, which is a U.S. national phase application of PCT/EP2005/010380 filed on Sep. 26, 2005, which claims priority to European Patent Application No. 05000499.3 filed Jan. 12, 2005.

The present invention relates to a lumbar support assembly, and in particular to a lumbar support assembly for incorporation into a seat frame in order to provide a seat structure. More especially, the present invention relates to a lumbar support assembly comprising a support arrangement for providing load bearing support for upholstery of a seat, e.g. a support arrangement having two lateral side members, preferably two lateral side wires, and a plurality of transverse members, preferably transverse wires, extending between the two side members.

Support assemblies of the aforementioned kind are very well known and may have various configurations determined by the design of a seat in which the support assembly is to be mounted (see WO 95/00039 A, e.g.).

EP 0 874 575 B1 proposes a support assembly for incorporation into a seat frame, the support assembly comprising a wire framework having two lateral side wires suspendable in the seat frame and a plurality of transverse wires providing load bearing support for upholstery of the respective seat and extending between the lateral side wires. Furthermore, according to this support assembly, one or more of the transverse wires extend laterally beyond the side wires after having been wound around the latter, and one or more of the transverse wires terminate in free ends that can flex independently of one another relatively to a portion of the wire framework bounded by the lateral side wires. These free ends are formed into hook-like fingers which can provide laterally contoured support in the lumbar region of the support assembly without interfering with the arching of the two lateral side wires. The hook-like fingers can also serve as anchorages for tension springs or like suspension means for the suspension of the support assembly in a seat frame. The fact that the extended portions of the transverse wires terminate in free ends acting as fingers, rather than being connected to an edge wire, enables more versatile lateral support to be provided, particularly in the lumbar region of a back rest, as the fingers can be individually angled, if desired, to conform to the contour of the seatback.

Lumbar support assemblies are incorporated in a seat frame of a back rest in order to support the lumbar region of a person sitting on the respective seat. When using a lumbar support assembly having a wire framework of the kind described above, this can be accomplished by pulling the two lateral side wires of the wire grid or suspension pad to the front. For example, EP 0 552 904 A1 discloses such a lumbar support assembly comprising a support arrangement in the form of a platform element suspended by tension springs in a seat frame to support the cushioning of a back rest. The support arrangement has two lateral side wires and a plurality of transverse wires, and two Bowden cables are linked between respective portions of the lateral side wires to apply a force of longitudinal compression, whereby the side wires are caused to be hinged outwardly at an articulation point to vary the lumbar support provided by the transverse wires.

Since the two side wires or side rails of the support arrangement of the lumbar support assembly should be arched by the same degree at the same time, it is necessary to shorten the extension of both Bowden cables by a respective actuator mechanism at the same time to create a symmetric lumbar support feeling, which however is difficult to achieve and requires two separate Bowden cable arrangements.

Therefore, the object underlying the present invention is to provide a lumbar support assembly having a support arrangement for providing load bearing support for upholstery of a seat, in which an adjustable lumbar support functionality and, in particular, a symmetric lumbar support feeling can be realized easily with only few components and at low cost.

According to the present invention, this object is achieved by a lumbar support assembly as defined by independent claim 1. The dependent claims define preferred and advantageous embodiments of the present invention.

The lumbar support assembly of the present invention comprises a support arrangement, e.g. a wire framework having two side members, preferably two lateral side wires or side rails, and a plurality of transverse members, preferably transverse wires, extending between the two side members. The support arrangement is in particular adapted to be suspended in a seat frame. Furthermore, the lumbar support assembly of the present invention comprises a Bowden cable arrangement having a wire guided in a sheath. The Bowden cable arrangement is coupled to the support arrangement and adapted to arch or curve the support arrangement at least in a lumbar region of the support arrangement by acting on the two opposite sides of the support arrangement.

According to the present invention, the sheath of the Bowden cable arrangement is attached to a first one of the two sides by first attachment means and to a second one of the two sides by second attachment means. A first end portion of the wire of the Bowden cable arrangement extends from the first attachment means and the sheath of the Bowden cable arrangement to be connected to the seat frame, while a second end portion of the Bowden cable arrangement extends from the sheath to be connected to an actuator for adjusting the tension of the wire, thereby adjusting the curvature and consequently the degree of lumbar support accordingly.

The first and second attachment means at least partly embrace the elongate side members and may be formed as a clip to be clipped onto the respective side member. The second attachment means may have an opening for connecting means, e.g. a spring, for connecting the second attachment means and the respective second side member of the support arrangement to the seat frame.

The first end portion of the wire of the Bowden cable arrangement preferably has a shape to be hooked into the seat frame. In particular, this first end portion may have a Z-nipple or a hook. Further, the first end portion may comprise a spring so as to provide additional flexibility to the lumbar support assembly.

The transverse members, preferably in the form of transverse wires, may have angled portions to provide regions of the support arrangement of differing transverse width between the side members so that the support arrangement itself becomes extensible under loading placed upon the seat. Some or all of the transverse wires may be wound around the side wires so as to attach the transverse wires thereto. Some of the transverse wires may extend beyond the lateral side wires and terminate in free ends, some of the free ends being formed into hook-like fingers.

According to a preferred embodiment of the present invention, the sheath of the Bowden cable arrangement extends between the first and second attachment means in the transverse direction of the support arrangement so that the Bowden cable arrangement starts with the Z-nipple to be attached to the front of a seat frame edge, continues to the first attachment means in the form of a clip, where the sheath of the Bowden cable arrangement is attached to a first one of the side members, and then continues in the transverse direction of the support arrangement to the second one of the side members, where the sheath of the Bowden cable arrangement is attached by the second attachment means, again preferably in the form of a clip, to the second side member. This second attachment means is connected to another front edge of the seat frame by the aforesaid connecting means, preferably a spring. From these second attachment means the Bowden cable arrangement extends to an appropriate actuator mechanism so as to adjust the tension of the wire of the Bowden cable arrangement and, thereby, the curvature of the support arrangement in the lumbar support region. For this purpose, the wire of the Bowden cable arrangement may have a thickening or a nipple to be coupled to the actuator mechanism so that the wire or cable of the Bowden cable arrangement can be pulled by the actuator mechanism.

According to the present invention, the two Bowden cables necessary according to the prior art are replaced by only one Bowden cable so that the lumbar support assembly can be manufactured at lower cost and has a simplified design which also allows to reduce the size of the actuator mechanism.

The lumbar support assembly of the present invention is preferably incorporated into a seat frame of a seat structure.

Furthermore, the support arrangement of the lumbar support assembly of the present invention may have side wires and transverse wires, but in principle can be realized with any kind of elongate side members and transverse members having a sufficient elasticity and flexibility so as to arch the support arrangement at least in the lumbar region of the support arrangement by actuating the Bowden cable arrangement.

In the following, a preferred embodiment of the present invention will be explained in detail with reference to the drawings.

Figure 2:
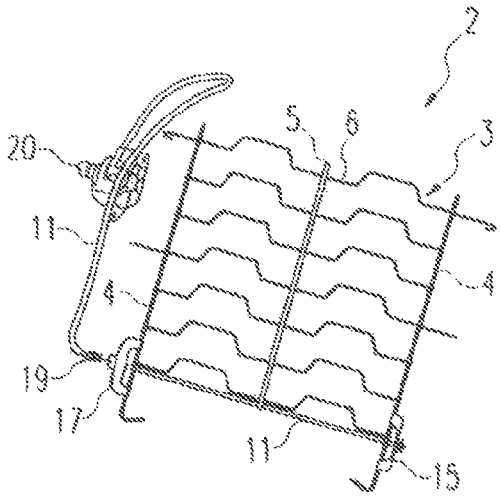
Figure 3A:
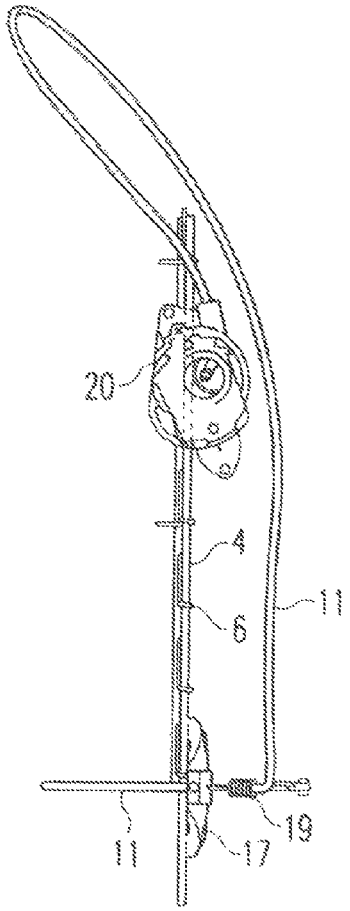
Figure 3B:
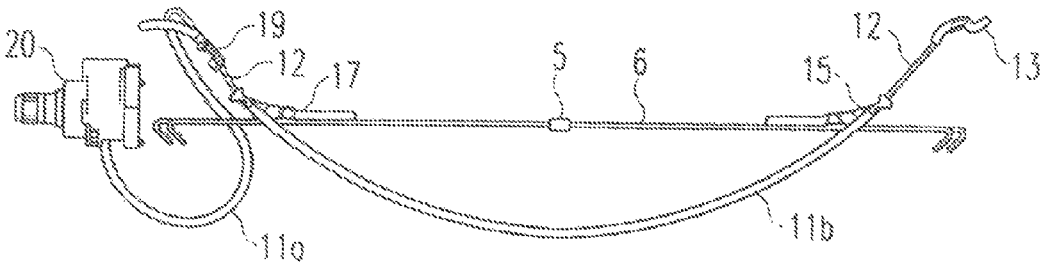
Figure 4:
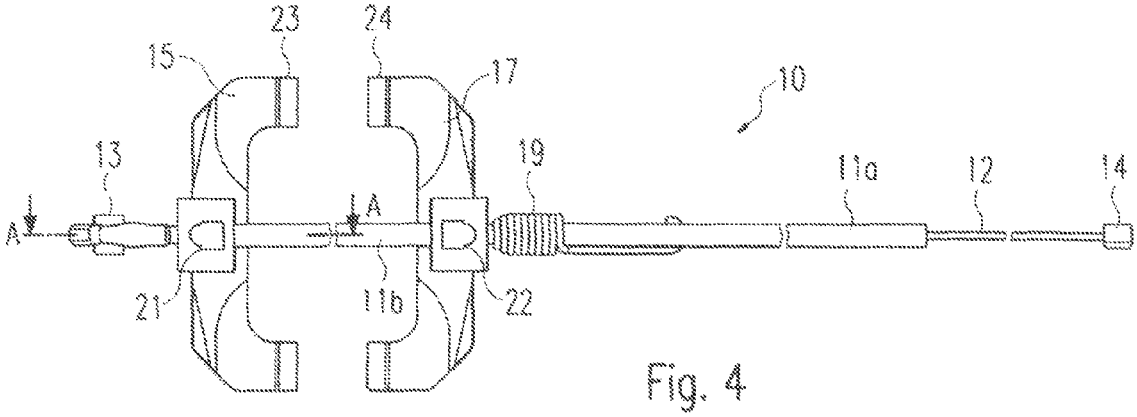
Figure 5:
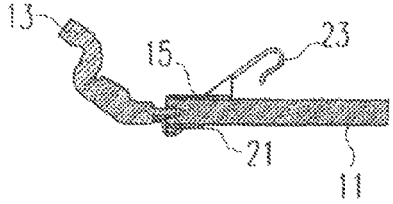
Figure 6:
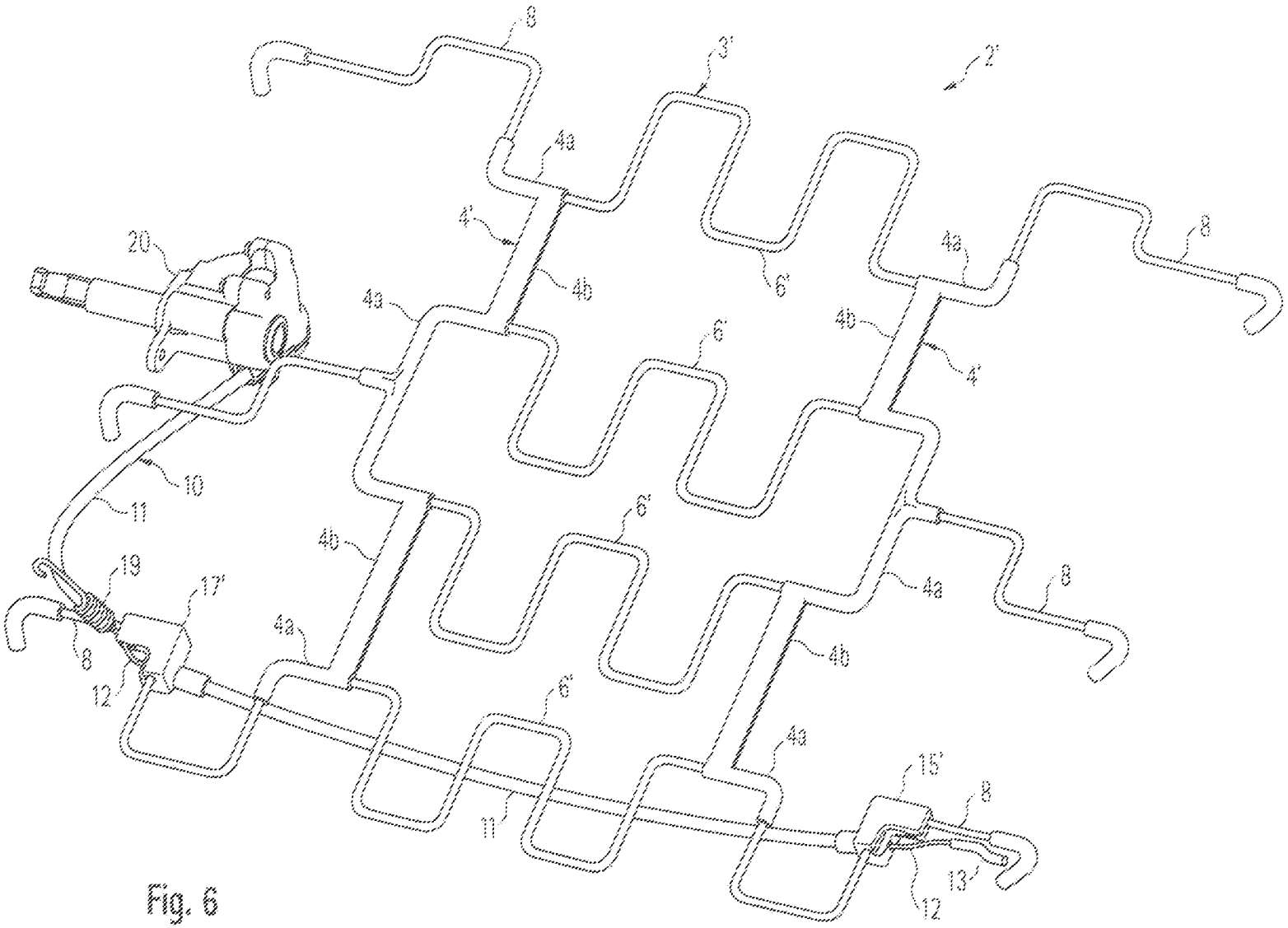
Figure 7:
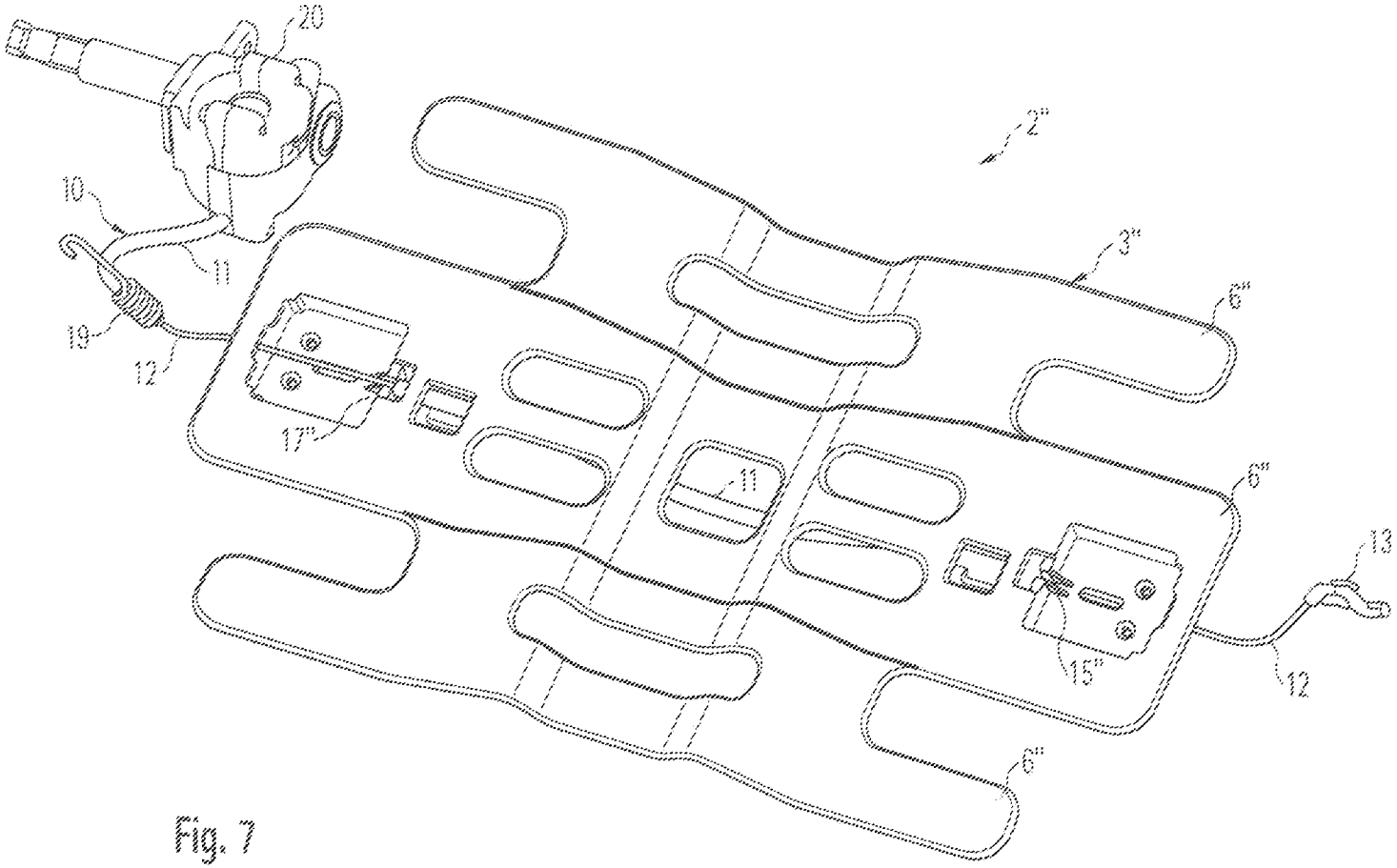
Figure 8:
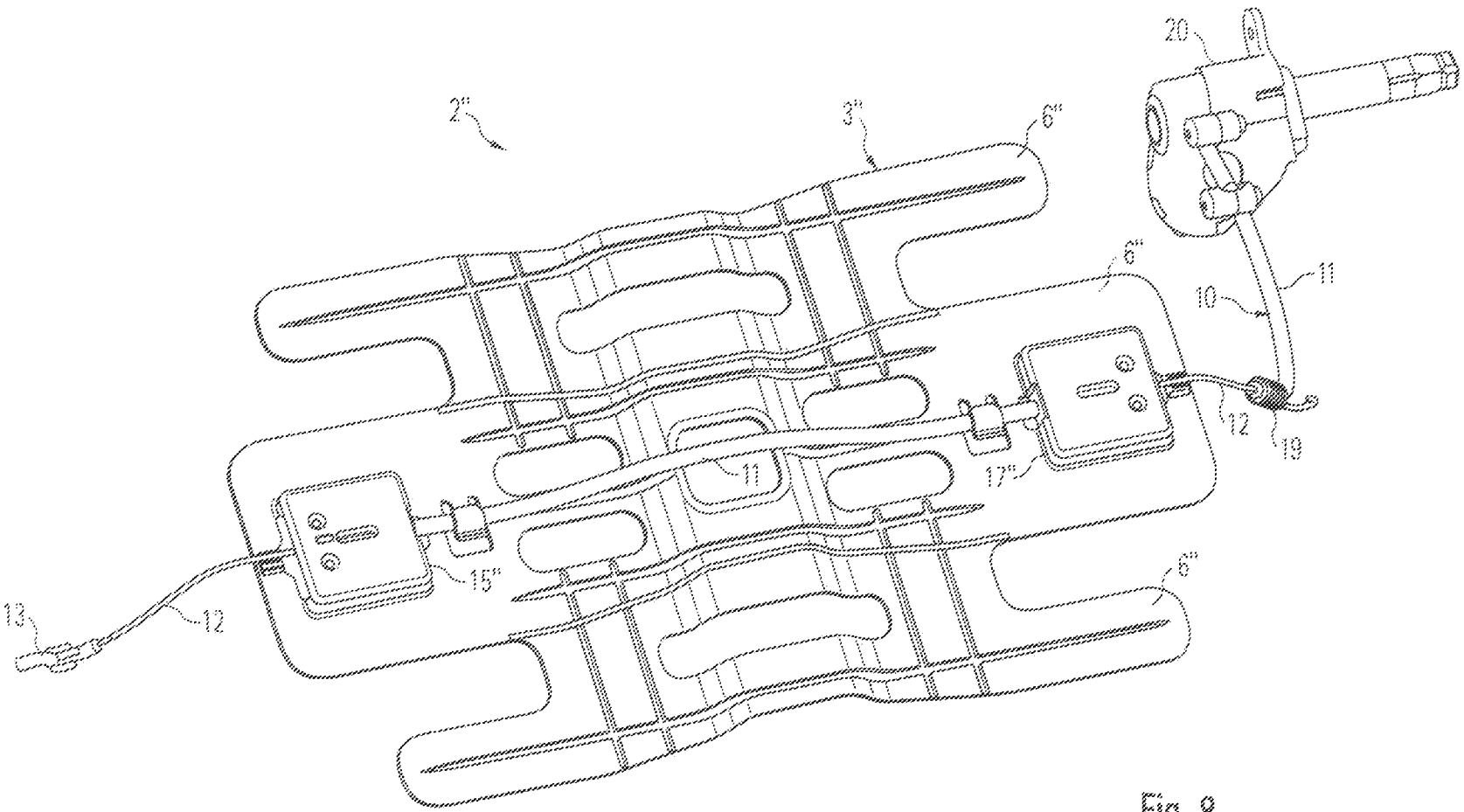

FIG. 1 shows a front view of a lumbar support assembly according to an embodiment of the present invention, FIG. 2 shows a perspective view of the lumbar support assembly of FIG. 1, FIGS. 3A and 3B show different side views from the right and the top, respectively, of the lumbar support assembly of FIG. 1, FIG. 4 shows a schematic view of a Bowden cable arrangement and attachment means for attaching the Bowden cable arrangement to the lumbar support assembly shown in FIG. 1, FIG. 5 shows a cross-sectional view of the Bowden cable arrangement of FIG. 4 along line A-A, FIG. 6 shows a perspective view of a lumbar support assembly according to a further embodiment of the present invention, FIG. 7 shows a perspective front view of a lumbar support assembly according to the still further embodiment of the present invention, and FIG. 8 shows a perspective rear view of the lumbar support assembly shown in FIG. 7.

FIG. 1 shows a lumbar support assembly 2 according to a preferred embodiment of the present invention, the lumbar support assembly 2 being incorporated or suspended in a schematically shown seat frame of a back rest of a seat and providing load bearing support for upholstery or cushioning of the seat. The lumbar support assembly 2 comprises a support arrangement 3 which is also called a suspension pad or a platform element and is formed as a wire framework. The support arrangement 3 comprises a pair of side wires 4 forming two elongate side members and a plurality of transverse wires 6 as transverse members extending between the two side wires 4. The transverse wires 6 are anchored to the side wires 1 and 2. According to the embodiment shown in FIG. 1, the transverse wires 6 are anchored to the side wires 4 by being wound around the latter. Intermediate portions 7 of the transverse wires 6 are angled in the support plane so that the support arrangement 3 itself becomes extensible under loading placed upon the support arrangement.

The side wires 4 may be formed by paper-wrapped steel cords and form two generally vertical lateral rails. The transverse wires 6 extending between the two side wires 4 penetrate an intermediate vertical cord 5 of paper or synthetic plastic material Which serves to provide some degree of stability to the wire framework comprising the two side wires 4 and the transverse wires 6 and maintains a predetermined vertical spacing between the transverse wires 6.

As shown in FIG. 1, the lower ends of the side wires 4 are angled so as to allow the incorporation of the support arrangement 3 into the seat frame 1. The support arrangement 3 can be suspended in the seat frame 1 by means of tension springs indicated in broken lines at 9, anchored between the seat frame 1 and the lower ends of the side wires 4 and some of the transverse wires 6, respectively. As can be taken from FIG. 1, some of the transverse wires 6 extend laterally beyond the side wires 4 after having been wound around the latter and terminate in free ends 8. Some of these free ends 8 are formed into hook-like fingers which may extend in the support plane or may also be directed backwards or in any other suitable direction which allows to anchor a tension spring 9 to the respective hook-like fingers. The fact that the extended portions 8 of the transverse wires 6 terminate in free ends enables more versatile lateral support to be provided, particularly in the lumbar region of a back rest. In particular, the hook-like fingers of the free ends 8 can be individually angled, if desired, to conform to the contour of the back rest. Furthermore, the fact that the laterally extending free ends 8 are unconnected also enables an effective adjustable lumbar support to be provided by arching of the two side wires 4 at least in the lumbar region of the support arrangement 3, which will be described in the following in more detail, as the free ends 8 can provide laterally contoured support in the lumbar region without interfering with the arching of the two side wires 4.

If desired, the two side wires 4 may be angled to provide regions of the support arrangement of the differing transverse width between these side wires 4.

The lumbar support assembly 2 described so far could be used to provide nonadjustable lumbar support. However, according to the embodiment of FIG. 1, adjustment means are provided for adjustably arching of the side wires 4 to enable horizontal adjustment of the lumbar support. These adjustment means comprise an actuator 20, which can be a manual actuator or an electrically driven actuator, and a Bowden cable arrangement 10 being engaged with both side wires 4. The special feature about the Bowden cable arrangement 10 shown in FIG. 1 is that it is designed, arranged and coupled to the side wires 4 such that it allows to arch the two side wires 4 symmetrically in the lumbar region of the lumbar support arrangement 3 using only one single Bowden cable.

The composition and structure of this special Bowden cable arrangement is shown in FIG. 4 in detail, and its functionality can be easily understood when additionally referring to FIG. 1. FIG. 5 shows a cross-sectional view of FIG. 4 along line A-A.

The Bowden cable arrangement 10 shown in FIG. 4 comprises a single Bowden cable having a sheath or conduit 11 and a wire 12 being movably guided in the sheath 11. The wire 12 starts with a nipple or thickening 14 which, in principle, can have any shape as long as it can be inserted into or coupled with the actuator 20 in such a way that a pulling force can be exerted by the actuator 20 on the wire 12 in order to increase the tension of the Bowden cable resulting in an increased curvature of the support arrangement 3. On the other hand, by releasing the tension of the Bowden cable by means of the actuator 20, the curvature of the support arrangement 3 can be decreased accordingly.

Starting from the end portion 14 of the wire 12, the Bowden cable continues to an attachment means 17 in the form of a plate clip which can be clipped onto the left side wire 4 of the support arrangement 3 (see FIG. 1) so as to attach the plate clip 17 and the Bowden cable arrangement to the left side wire 4 of the support arrangement 3. The Bowden cable is securely clamped by the plate clip 17 at 22 and consequently fixed to the plate clip 17. The plate clip 17 has two end portions 24 being formed like a resilient or flexible hook or clip so that these end portions 24 can be easily clipped onto the side wire 4.

The Bowden cable then continues from the plate clip 17 to a further plate clip 15 which has the same shape and the same structure as the plate clip 17.

Consequently, the plate clip 15 has a clamping position 21 through which the Bowden cable, i.e. the sheath 11 with the wire 12 in it, is guided in order to securely clamp the Bowden cable and secure it to the plate clip 15. Furthermore, the plate clip 15 has end portions 23 having the shape of a flexible hook or clip for attaching the plate clip 15 to the right side wire 4 of the support arrangement 3 (see FIG. 1).

As indicated in FIG. 1, both plate clips 15, 17 have holes or openings 16, 18. As to the plate clip 17, in this opening 18 a spring 19 may be inserted which acts as a connecting means for connecting the plate clip 17 to a front edge of the seat frame 1, as also indicated in FIG. 1. However, this connecting means can have any shape and structure as long as it serves to hold the plate clip 17 at the front edge of the seat frame 1, as the suspension is created in the middle part of the support arrangement 3. As to the plate clip 15, the wire 12 of the Bowden cable is guided through the opening 16 of the plate clip 15 and ends in an end portion 13 which is shaped so as to allow to easily attach the wire 12 to the right front edge of the seat frame 1 (see again FIG. 1). According to the embodiment shown in FIG. 1 and FIG. 4, this end portion 13 is a Z-nipple which, thus, can be easily hooked into the front edge of the seat frame 1.

As shown in FIG. 1, the Bowden cable 10 thus extends from the actuator 20 to the plate clip 17, where it is attached to the plate clip 17 and where the plate clip 17 is attached or anchored to the left front edge of the seat frame 1 by means of the spring 19. From the plate clip 17 the Bowden cable 10 extends in the transverse direction of the support arrangement 3 to the plate clip 15, where it is attached to the plate clip 15 and where the sheath 11 of the Bowden cable 10 terminates. The wire 12 of the Bowden cable 10 continues from the plate clip 15 and ends in the Z-nipple 13 which is attached or anchored to the right front edge of the seat frame 1. Consequently, when the actuator 20 is actuated to pull the wire 12 in the Bowden cable 10 resulting in an increase of tension of the wire 12, both side wires 4 of the support arrangement 3 are at the same time and to the same degree pulled to the front in FIG. 1 to create a symmetric lumbar support effect in the lumbar region of the support arrangement 3. In a similar manner the lumbar region of the support arrangement 3 can move backwards in FIG. 1 if the actuator 20 is actuated to decrease the tension of the wire 12 of the Bowden cable 10.

As shown in FIG. 3B, the lumbar support assembly 2 is configured in such a manner that the spring 19 is connected to the sheath 11 of the Bowden cable 10. The sheath 11 of the Bowden cable 10 comprises two portions 11*a*, 11*b* which are separated from each other. A first portion 11*a* extends from the actuator 20 to the spring 19. A second portion 11*b* extends from the plate clip 17 to the plate clip 15. Only the wire 12 of the Bowden cable 10 extends between the spring 19 and the plate clip 17. Consequently, the spring 19 is connected to the plate clip 17 via the wire 12 of the Bowden cable 10. As can be seen, both sides of the support arrangement 3 can be connected to the seat frame via portions of the wire 12 extending from the plate clips 15 and 17. By increasing the tension in the Bowden cable 10, the portions of the wire 12 extending from the plate clips 15 and 17 can be symmetrically shortened, thereby pulling the support arrangement 3 towards the seat frame 1.

Consequently, the lumbar support assembly 2 described above and shown in the figures uses only one single Bowden cable 10 to provide adjustable lumbar support by acting at the same time on both side wires 4 of the lumbar support assembly 2.

FIG. 6 shows a lumbar support assembly 2' according to a further embodiment of the present invention. The principle of operation and the general structure of the lumbar support assembly 2' substantially correspond to that of the lumbar support assembly 2. However, a different type of support arrangement is used. In FIG. 6, components which are similar to that of the lumbar support assembly 2 have been designated with the same reference numerals. In the following, only the differences of the lumbar support assembly 2' as compared to the lumbar support assembly 2 will be described.

The support arrangement 3' of the lumbar support assembly 2' comprises corrugated transverse wires 6' which are connected by means of longitudinal members 4' formed of a plastic material. Connecting portions 4*a* of the longitudinal members 4' are formed so as to enclose portions of the transverse wires 6' and thereby provide a secure connection thereto. Band-like portions 4*b* of the longitudinal members 4' are formed between the connecting portions 4*a*. The band-like portions 4*b* provide the support arrangement 3' with a desired degree of flexibility.

The mechanism for adjusting the degree of support of the lumbar support assembly 2' generally corresponds to that of the lumbar support assembly 2. However, a different type of plate clips is used. In the support assembly 2' of FIG. 6, the plate clips 15' and 17' are formed of a plastic material. The plate clips 15' and 17' are configured to be clipped to longitudinal portions of the lowermost transverse wire 6' at opposite ends thereof. The wire 12 of the Bowden cable 10 extends from the plate clips 15' and 17'.

Some of the transverse wires 6' have end portions 8 which are provided with hook-like extensions to be attached to the seat frame. The hooks are covered with a plastic material so as to reduce undesirable noise which is generated due to friction between the hook-like extensions and the seat frame.

FIG. 7 shows a lumbar support assembly 2" according to a still further embodiment of the invention. FIG. 8 shows the lumbar support assembly 2" as viewed from the rear side. The mechanism for adjusting the degree of support generally corresponds to that of the lumbar support assemblies 2 and 2'. However, a different type of support arrangement is used. In FIGS. 7 and 8, components corresponding to that of the lumbar support assembly 2 have been designated with the same reference numerals and further description thereof will be omitted.

The support arrangement 3" is formed of a plastic material and comprises a number of belt-like portions 6" extending along the transversal direction. For attaching the sheath 11 of the Bowden cable 10 to the support arrangement 3" at opposite sides thereof, attachment portions 15" and 17" are integrally formed in one of the belt-like portions 6". As with the plate clips 15, 15' and 17, 17', the wire 12 of the Bowden cable 10 extends from the attachment portions 15" and 17".

As described above, the mechanism for adjusting the degree of support according to the present invention can be applied to a variety of support arrangements. The attachment means for attaching the sheath of the single Bowden cable to the support arrangement can be adapted to the specific type of support arrangement.

In all the above embodiments, the end portion 13 of the wire 12 of the Bowden cable 10 can additionally be provided with a tension spring so as to increase the flexibility of the lumbar support assembly. This is especially advantageous in the case of a support arrangement which has a relatively low intrinsic flexibility, such as the belt-type support arrangement 3" of FIGS. 7 and 8. Instead of the Z-nipple, it is also possible to use a hook-like extension for connecting the end portion 13 of the wire 12 to the seat frame.

The invention claimed is:

1. A lumbar support assembly, comprising a support arrangement adapted to be incorporated into a seat frame, a Bowden cable arrangement comprising a wire guided in a sheath and being coupled to the support arrangement and being adapted to arch the support arrangement at least in a lumbar region of the support arrangement by acting on two opposite sides of the support arrangement, a first attachment device for attaching the sheath of the Bowden cable arrangement to a first side of the support arrangement, and a second attachment device for attaching the sheath of the Bowden cable arrangement to a second side of the support arrangement wherein the sheath of the Bowden cable arrangement extends between the first and second attachment devices, wherein a connecting device is provided for connecting the sheath of the Bowden cable arrangement to the seat frame, the connecting device comprising a spring which is connected with a first end to the Bowden cable arrangement and which has a second end to be connected to the seat frame, and wherein the sheath of the Bowden cable arrangement extends between the first and second attachment devices in a transverse direction of the support arrangement.

2. The lumbar support assembly according to claim 1, wherein a first end portion of the wire of the Bowden cable arrangement extends from the first attachment device and is adapted to be connected to the seat frame, and wherein a second end portion of the wire of the Bowden cable arrangement is adapted to be connected to an actuator for adjusting the tension of the wire of the Bowden cable arrangement.

3. The lumbar support assembly according to claim 2, wherein the first end portion of the wire of the Bowden cable arrangement has a shape to be hooked into the seat frame.

4. The lumbar support assembly according to claim 2, wherein the first end portion has the shape of a Z-nipple.

5. The lumbar support assembly according to claim 1, wherein a connecting device is provided for connecting the second attachment device to the seat frame.

6. The lumbar support assembly according to claim 5, wherein the connecting device comprises a spring which is connected with a first end to the second attachment device and which has a second end to be connected to the seat frame.

7. The lumbar support assembly according to claim 1, wherein the sheath of the Bowden cable arrangement comprises a first portion and a second portion which are separated from each other, the first portion of the sheath extending from the actuator to the connecting device and the second portion of the sheath extending from the second attachment device to the first attachment device.

8. The lumbar support assembly according to claim 1, wherein a plurality of tension springs is provided for connecting the support arrangement to the seat frame.

9. The lumbar support assembly according to claim 1, wherein the support arrangement comprises two side members and a plurality of transverse members extending between the side members.

10. The lumbar support assembly according to claim 9, wherein the first and second attachment devices are designed such that they at least partly embrace the first side member and the second side member, respectively.

11. The lumbar support assembly according to claim 10, wherein the first and second attachment devices have at least one clip portion for attaching the first attachment device and the second attachment device to the first side member and the second side member, respectively.

12. The lumbar support assembly according to claim 1, wherein the support arrangement comprises transverse wires which are connected by longitudinal members.

13. The lumbar support assembly according to claim 12, wherein the longitudinal members are formed of a plastic material.

14. The lumbar support assembly according to claim 13, wherein connecting portions of the longitudinal members are formed to enclose portions of the transverse wires, and wherein band-shaped portions of the longitudinal members are formed between the connecting portions of the longitudinal members.

15. The lumbar support assembly according to claim 12, wherein the first and second attachment devices are plate clips which are clipped to longitudinal portions of one of the transverse wires at opposite ends thereof.

16. The lumbar support assembly according to claim 1, wherein the first and second attachment devices are plate clips.

17. A seat structure, comprising a seat frame, a lumbar support assembly coupled to the seat frame and comprising a support arrangement, a Bowden cable arrangement comprising a wire guided in a sheath and being coupled to the support arrangement and being adapted to arch the support arrangement at least in a lumbar region of the support arrangement by acting on two opposite sides of the support arrangement, a first attachment device for attaching the sheath of the Bowden cable arrangement to a first side of the support arrangement, and a second attachment device for attaching the sheath of the Bowden cable arrangement to a second side of the support arrangement, wherein the sheath of the Bowden cable arrangement extends between the first and second attachment devices, and an actuator for adjusting the tension of the wire of the Bowden cable arrangement of the lumbar support assembly, the actuator being coupled to an end portion of the wire of the Bowden cable arrangement, wherein a connecting device is provided for connecting the sheath of the Bowden cable arrangement to the seat frame, the connecting device comprising a spring which is connected with a first end to the Bowden cable arrangement and which has a second end to be connected to the seat frame, and wherein the sheath of the Bowden cable arrangement extends between the first and second attachment devices in a transverse direction of the support arrangement.

18. The seat structure according to claim 17, wherein the lumbar support assembly is suspended in the seat frame.

19. A lumbar support assembly, comprising a support arrangement adapted to be incorporated into a seat frame;

a Bowden cable arrangement comprising a wire guided in a sheath and being coupled to the support arrangement and being adapted to arch the support arrangement at least in a lumbar region of the support arrangement by acting on two opposite sides of the support arrangement;

a first attachment device for attaching the sheath of the Bowden cable arrangement to a first side of the support arrangement; and a second attachment device for attaching the sheath of the Bowden cable arrangement to a second side of the support arrangement wherein the sheath of the Bowden cable arrangement extends between the first and second attachment devices, wherein the support arrangement comprises at least one belt-shaped portion extending in a transverse direction of the lumbar support assembly.

20. The lumbar support assembly according to claim 19, wherein the first and second attachment devices are formed integrally in one of the at least one belt-shaped portions.

21. The lumbar support assembly according to claim 19, wherein the support arrangement comprises a plurality of belt-like portions extending in the transverse direction of the lumbar support assembly, and wherein the first and second attachment devices are integrally formed in one of the pluralities of belt-shaped portions.

* * * * *